United States Patent [19]

Uematsu et al.

[11] Patent Number: 4,999,159

[45] Date of Patent: Mar. 12, 1991

[54] HEAT-RESISTANT AUSTENITIC STAINLESS STEEL

[75] Inventors: Yoshihiro Uematsu, Kudamatsu; Isami Shimizu, Yamaguchi; Naoto Hiramatsu, Tokuyama, all of Japan

[73] Assignee: Nisshin Steel Company, Ltd., Japan

[21] Appl. No.: 479,289

[22] Filed: Feb. 13, 1990

[51] Int. Cl.[5] ..... C22C 38/44

[52] U.S. Cl. ..... 420/53; 420/50; 420/51; 420/52

[58] Field of Search ..... 420/50, 51, 52, 53, 420/54

[30] Foreign Application Priority Data

Dec. 20, 1988 [JP] Japan ..... 64-330128

[56] References Cited

U.S. PATENT DOCUMENTS 2,984,563 5/1961 Tanczyn ..... 420/51

4,011,133 3/1977 Bloom et al. ..... 420/51

FOREIGN PATENT DOCUMENTS 45-34011 10/1970 Japan .

*Primary Examiner*—Deborah Yee

*Attorney, Agent, or Firm*—Webb, Burden, Ziesenheim & Webb

[57] ABSTRACT

A heat-resistant austenitic stainless steel is disclosed. This steel essentially consists of: not more than 0.06% C, 1-4% Si, 0.5-4% mn, not more than 0.035% P, not more than 0.005% S, 10-17% Ni, 14-20% Cr, 1-4% Mo, 0.01-0.5% Al, not more than 0.035% N, and balance essentially Fe, and may further contain small amounts of any of Cu, REM and B and the composition thereof is adjusted so that a limited amount of δ-ferrite appears in solidification. The steel has excellent hot salt corrosion resistance, weldability, salt errosion resistance of the weld and hot-workability.

13 Claims, 4 Drawing Sheets

HEAT-RESISTANT AUSTENITIC STAINLESS STEEL

FIELD OF THE INVENTION

This invention relates to a heat-resistant austenitic stainless steel which has excellent high temperature salt corrosion resistance as well as hot salt corrosion resistance of welds in addition to weld hot cracking resistance, hot-workability and weldability, and is usable in hot-corrosive environments, especially under conditions that the steel is subjected to repeated heating and cooling in environments in which corrosion by salt, including corrosion by molten salt, may occur.

BACKGROUND OF THE INVENTION

Heat-resistant steels are employed for uses under severely corrosive conditions such as automobile exhaust emission control systems, parts of furnaces, parts of heat-exchangers, electric appliances for cooking such as electric range and grill. Such steels are required to be provided with hot gas corrosion resistance under burning conditions, hot corrosion resistance in environments containing various oxides such as PbO, $V_2O_5$, etc., chlorides such as $PbCl_2$, NaCl, $MgCl_2$, KCl, etc., and resistance to hot corrosion by molten salt in addition to general high temperature characteristics such as high temperature strength, high temperature oxidation resistance, adherence of scale, etc. Further, these steels must be resistive to wet corrosion by condensed water at low temperatures. Under these severely corrosive environments, carbon steel sheets which are surface-treated for heat resistance cannot stand, and, therefore, heat-resistant austenitic stainless steels are used.

It is known and is a problem to be solved that incinerators for treating a large quantity of waste materials, tuyere burners of blast furnaces, heavy oil burners, exhaust gas pipes of internal combustion engines, etc. and parts of apparatus which are used in environments in which adhesion of salt or ash occurs such as in the cold districts where antifreezing agents are sprinkled on the roads, often suffer remarkable high temperature corrosion. Investigations of cases of this kind of corrosion have revealed that accelerated oxidation of intergranular corrosion type is observed in common in all the cases. This is a corrosion by adhering salt or molten salt and the corrosion with chlorides is marked.

For this kind of corrosion, known heat resistant stainless steels such as SUS304, SUS321, SUS310S, etc. are not satisfactory.

Generally, high degree addition of Si and Mo is effective for improvement of corrosion resistance. However, such high alloying deteriorates hot workability, reduces production yields, roughens the surface of steel in manufacturing, and makes difficult pipe-making and welding in application. Also it has been revealed that welds are often selectively and remarkably corroded by hot salt although the parent metal is sound when a fresh material is subjected to high temperatures in environments where the material comes into contact with a high concentration salt solution.

Japanese Laid-Open Patent Publication No. 63-213643 (1988) discloses a stainless steel having excellent high temperature corrosion resistance in the presence of chlorides, said steel comprising not more than 0.03% C, 10–20% Cr, 10–30% Ni, not more than 2% Mn, 1–6% Si, 0.5–5% Mo and 0.02–0.4% N, wherein the D value defined as 24.4 Cr+28 Ni+6.7 Mn−48.8 Si−56.9 Mo−148.0 Nb is not more than 500. The steel may contain 0.1–1% in total of at least one of Ti, Zr, Nb and Ta. However, improvement in weld hot cracking resistance is not considered in this steel.

Therefore, there is a demand for a heat-resistant anstenitic stainless steel which is provided with both excellent weld hot crocking resistance and excellent hot workability in addition to hot salt corrosion resistance.

We made an intensive research in order to improve hot salt corrosion resistance, weld hot cracking resistance and hot-workability of the heat-resistant austenitic stainless steel simultaneously and have found that these properties can be improved by adding limited amounts of Si and Mo for the purpose of improvement of hot salt corrosion resistance; adding a limited amount of Cu from the viewpoint of stress corrosion cracking resistance or weatherability, if desired; adding limited amounts of Nb, Ti or V for the improvement of resistance to intergranular attack hot corrosion and intergranular corrosion by combination attack in the cool state, high temperature strength as well as hot workability; and adding limited amounts of B and REM for the improvement of hot workability and weld hot cracking susceptibility.

SUMMARY OF THE INVENTION

The above-described purpose is achieved by providing a heat-resistant austenitic stainless steel basically comprising:

c: not more than 0.06%
Si: 1–4%
Mn: 0.5–4%
P: not more than 0.035%
S: not more than 0.005%
Ni: 10–17%
Cr: 14–20%
Mo: 1–4%
Al: 0.01–0.5%
N: not more than 0.03% which, if desired, may contain:

Cu: 0.5–2.5%, further at least one of Nb, Ti and V: 0.05–0.5% in total and/or

B: 0.0005–0.02%, and further one or more of REM: 0.005–0.1%, the balance being Fe and unavoidable impurities, wherein the value of (Si %+Mo %) (Formula (1) below) is not less than 3, the value % (2.5 Si %+Mo %) (Formula (2) below) is not more than 11 and the D value represented by Formula (3) below is not less than 6 and not more than 11, when the steel contains REM or B from the viewpoint of weldability, and is not less than 7 and not more than 11 when the steel does not contain these elements.

$$(\text{Si }\% + \text{Mo }\%) \geqq 3 \quad (1)$$

$$(2.5\ \text{Si }\% + \text{Mo }\%) \leqq 11 \quad (2)$$

$$D = (\text{Cr }\% + 1.5\ \text{Si }\% + \text{Mo }\% + 3\ \text{Al }\% + 2.6\ \text{Ti }\% + 0.5\ \text{Nb }\% + 0.5\ \text{V }\%) - (\text{Ni }\% + 30\ \text{C }\% + 30\ \text{N }\% + 0.5\ \text{Mn }\% + 2\ \text{Cu }\%) \quad (3)$$

The D values as defined above of all the steels of the working examples described in the above-mentioned Japanese Laid-Open Patent Publication No. 63-213643 are less than 4. We have found that the weld hot cracking resistance of austenitic stainless steels containing high-Mo high-Si is improved by adjusting the composition so that said D value is more than 6 or 7.

The preferred steels of the present invention have the composition: C: 0.03–0.06%, Si: 2–3%, Mn: 0.5–1%, P: not more than 0.03%, S: not more than 0.005%, Ni: 12–16%, Cr: 16–18%, Mo: 2–3.2%, Al: 0.01–0.03%, N: not more than 0.03% and the balance being Fe and unavoidable impurities.

The more preferred steels of the present invention have the composition: C: 0.03–0.05, Si: 2–2.8, Mn: 0.5–1%, P: not more than 0.03, S: not more than 0.005%, Ni: 12–14, Cr: 16–18%, Mo: 2–2.8, Al: 0.01–0.03%, N: not more than 0.03% and the balance being Fe and unavoidable impurities.

The reasons why the composition is defined above is as follows.

C: This element that is unavoidable is a strong austenite former and an important necessary component for the steel of the present invention from the viewpoint of the composition balance. Carbon is also useful for saving expensive nickel. Further C is an interstitial solute and effective for enhancing the high temperature strength. However, the addition of an excessive amount of C makes the steel brittle and deteriorates workability. From such consideration, the upper limit of the content is defined as 0.06%. On the other hand, the reduction of the C content lengthens the refining time and thus invites increase of the manufacturing cost and at least 0.03% of C is required for the desired high temperature strength.

Si: This element is one of the most important components that improve oxidation resistance and high temperature salt corrosion. At least 1% and preferably 2% of this element is required to achieve the satisfactory effect thereof. On the other hand, Si induces precipitation of the $\sigma$-phase, which deteriorates toughness of the steel. Also, this element deteriorates hot workability, weldability and formability. From the consideration of these facts the upper limit content of this element is defined as 4%, preferably, 3%.

Mn: This element is effective for fixing and excluding the deleterious S as MnS. If the Mn content is not sufficient, MnS deposits as a film at the granular interfaces and promotes deterioration of the intergranular strength. But MnS globurizes and reduces its effect for deteriorating intergranular strength when Mn is contained in higher concentration. At least 0.5% Mn is required but its effect saturates at around 4%. Thus the Mn content is defined as 0.5–4%. When the D value is considered, however, the Mn content is preferably not more than 1%.

P: This element is deleterious for weld hot cracking resistance like S. Therefore, the lower, the better. However, it invites increase in the manufacturing cost to reduce the P content excessively. The allowable limit is 0.035%.

S: As mentioned above with respect to P, this element is deleterious for weld hot cracking, and thus the lower, the better. However, reduction of the S content invites increase in the manufacturing cost. The allowable upper limit is 0.005%.

Ni: This element is one of the fundamental elements of austenitic stainless steels. From the viewpoint of the weld hot cracking resistance, the lower limit of the content thereof is defined as 10%, because $\delta$-ferrite must be formed in the weld. The upper limit is defined as 17% from the consideration of the balance of the composition and the manufacturing cost. When the D value is considered, however, the preferred content of Ni is 12–16%.

Cr: This is the most fundamental element of stainless steels for achieving oxidation resistance and corrosion resistance. With less than 14%, the steel cannot be even provided with the mere high temperature oxidation resistance in hot corrosive environments. If the content exceeds 20%, however, the adjustment of the composition becomes difficult, and the formation of $\delta$-ferrite increases, which invites difficulty in working. Therefore, the upper limit is defined as 20%. If the D value is considered, however, 16–18% is preferred.

Mo: This element is effective for achieving corrosion resistance in high temperature corrosive environments and high temperature salt-corrosive environments and thus must be positively added. The lower limit of the content thereof is defined as 1%, since the effect thereof cannot be well exhibited with less than 1%. However, Mo is an expensive element and promotes deposition of the $\sigma$-phase and thus invites deterioration of toughness of the steel. With addition of over 4%, hot workability of the steel is impaired. Therefore, the Mo content should be not higher than 4%. When the D value is considered, 2–3.2% is preferred.

Al: This is a most effective element for improvement of oxidation resistance and effective for improving the cleanness of the steel. It is desired that Al is contained in an amount of at least 0.01%. However, Al is a strong ferrite former and thus the upper limit is restricted to 0.5% from the viewpoint of the composition balance as well as of the toughness of the product. When the D value is considered, the preferred range is 0.01–0.03%.

B: This element is effective for enhancing intergranular strength and improving hot workability and weld hot cracking resistance. With less than 0.0005%, however, the effect is not remarkable. With more than about 0.02%, borides are formed, which degrade the intergranular strength. Therefore, the B content is defined as 0.0005–0.02%.

Nb, Ti and V: These elements combine with C and N to form minute precipitate and thus are effective for corrosion resistance as well as high temperature strength, especially for improvement of creep strength. These effects are manifested at the content of 0.05% or higher. However, as the content increases, workability and toughness are deteriorated. Therefore, the upper limit is defined as 0.5% in total. The preferred range is 0.05–0.4%.

REM: These elements fix deleterious S as high melting point compounds at the early stage of solidification and thus improve cracking susceptibility. Also, they are effective for enhancing the resistance to pealing off of the oxide scales which result from heating-cooling cycles. These effects are manifested at the content of 0.005% or higher. And this deteriorate intergranular strength at high temperatures, which spoils the improvement in the hot cracking susceptibility. On the contrary, when REM are contained in too high concentrations, large amounts of REM oxides deposit at the grain boundaries. Therefore, the upper limit is restricted to 0.1% or less.

Cu: This element is effective for improvement of stress corrosion cracking resistance and weatherability, for which at least 0.5% is required. On the other hand, when a large amount of Cu is contained, it is segregated in the grain boundaries and remarkably degrade hot workability. Therefore, the upper limit is defined as 2.5%. When the D value is considered, the preferred content range is 1–1.3%.

N: This element is effective for improvement of high temperature strength. However, excessive addition of N impairs workability and thus the upper limit is defined as 0.03% or less.

Further, the total amount of Si and Mo is regulated by formulas (1) and (2). The lower limit value (Si%+Mo%) must be 3 or more for better hot molten salt corrosion resistance. The upper limit value (2.5 Si %+Mo %) must be 11 or less in order to minimize degradation in hot workability, weld hot cracking resistance, $\sigma$-brittleness resistance and formability. The reason why the D value is defined as above in as follows. Steels containing high Si or high Mo are very susceptible to weld hot cracking. The D value is an index for precipitation of ferrite. The D value must be 6 or more when REM or B is contained and 7 or more when they are not contained. Appearance of a larger amount of $\delta$-ferrite causes hot work cracking and deteriorates manufacturability.

Considering these facts, the upper limit of the D value is defined as 11.

BRIEF DESCRIPTION OF THE ATTACHED DRAWINGS

Figure 1:
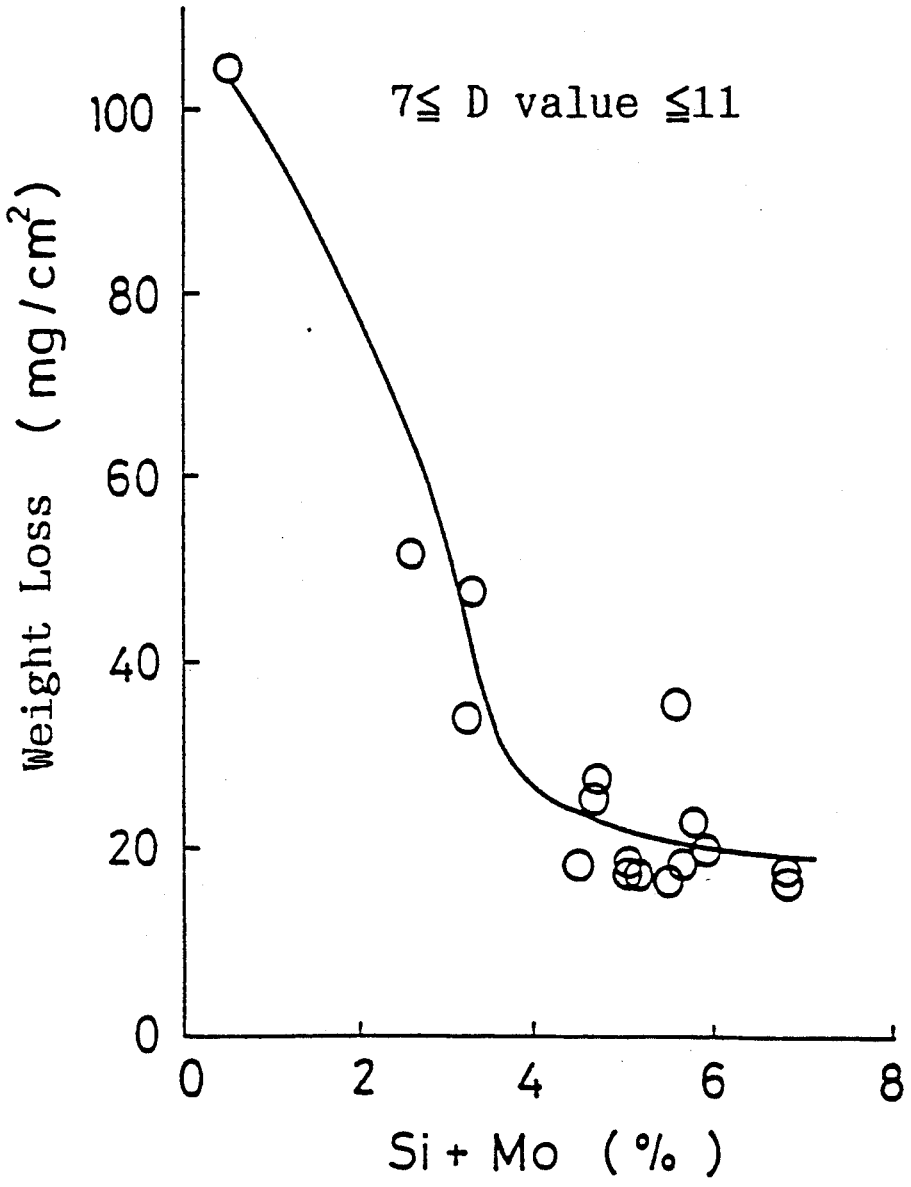
FIG. 1 is a graph showing the relation between the corrosion weight loss (mg/cm$^2$) and the (Si+Mo) % value with respect to the steels of the present invention.

tions of which are shown in Table 1 were prepared by vacuum melting and specimens thereof were subjected to the high temperature tensile tests and the high temperature salt corrosion test. For the high temperature tensile test, 20×20×110 mm pieces were prepared from ingots, the pieces were heat-treated at 1200° C. for 2 hours and they were worked into rod specimens having a diameter of 10 mm. For the high temperature salt corrosion test, ingots were forged into 30 mm thick plates, which were held at 1200° C. and thereafter hot-rolled to 5 mm in thickness and further reduced to 2 mm by ordinary cold rolling and the plates were finally annealed. They were finally made into 25×35 mm specimens, the surface of which was polished to #400. The high temperature salt corrosion test was carried out by immersing the specimens in a saturated aqueous salt solution at 20° C. for 5 minutes, held at 650° C. for 2 hours and air-cooled for 5 minutes, and repeating the above cycle 10 times. After the test, the specimens were descaled and the corrosion resistance was evaluated by corrosion weight loss. The results are indicated in Table 1. From the results, it is apparent that the weight loss of SUS302B and SUSXM15J1 containing high Si is remarkably smaller in comparison with SUS304 and SUS321. The weight loss is further reduced in E33–F96 which contains both Si and Mo. FIG. 1 shows the effect of the (Si+Mo) content to the high temperature salt corrosion resistance of the invention steels of which the D value is 7–11. From this figure, it is apparent that the corrosion weight loss of the steels of which the (Si+Mo) amount is not less than 3% is remarkably small, i.e., addition of not less than 3% of (Si+Mo) is very effective for the high temperature salt corrosion resistance. Generally, excellent heat resistance of austenitic stainless steels is brought about by the $Cr_2O_3$ film formed on the surface of the steels. Although this film exhibits excellent protective effect against atmospheric oxidation, it is not satisfactory in high temperature salt corrosion environments in which the steels of the present invention are to be used, and it is markedly corroded. It is considered that addition of not less 3% of (Si+Mo) makes the steel form an excellent protective film resistant to high temperature salt corrision environments.

TABLE 1

| | C | Si | Mn | P | S | Ni | Cr | Mo | Al | N | Others | (wt %) Wt. Loss (mg/cm$^2$) |
|---|---|---|---|---|---|---|---|---|---|---|---|---|
| SUS304 | 0.061 | 0.48 | 1.20 | 0.027 | 0.008 | 8.11 | 18.3 | — | — | 0.036 | — | 98 |
| SUS321 | 0.053 | 0.67 | 0.84 | 0.027 | 0.006 | 9.82 | 18.05 | — | — | 0.02 | Ti: 0.40 | 82 |
| SUS302B | 0.081 | 2.60 | 0.79 | 0.027 | 0.006 | 9.41 | 17.72 | — | — | 0.01 | — | 52 |
| SUSXM15J1 | 0.050 | 3.14 | 0.85 | 0.025 | 0.004 | 12.81 | 19.08 | — | — | 0.01 | Nb: 0.12 | 48 |
| E31 | 0.051 | 5.47 | 0.84 | 0.023 | 0.002 | 17.13 | 18.47 | — | 0.02 | 0.02 | Ti: 0.22 | 35 |
| E33 | 0.049 | 2.10 | 0.84 | 0.023 | 0.002 | 17.16 | 19.41 | 1.03 | 0.02 | 0.01 | Nb: 0.30 | 35 |
| E44 | 0.044 | 3.69 | 0.80 | 0.026 | 0.002 | 14.63 | 19.14 | 1.23 | 0.03 | 0.01 | Nb: 0.29 | 28 |
| E45 | 0.047 | 3.67 | 0.82 | 0.025 | 0.002 | 15.85 | 19.36 | 2.19 | 0.01 | 0.01 | Nb: 0.29<br>Ti: 0.10 | 23 |
| E46 | 0.047 | 3.58 | 0.82 | 0.025 | 0.004 | 16.60 | 19.30 | 3.29 | 0.02 | 0.01 | Nb: 0.30 | 18 |
| E55 | 0.032 | 3.74 | 0.77 | 0.026 | 0.001 | 14.13 | 16.9 | 2.01 | 0.02 | 0.01 | — | 18 |
| E57 | 0.034 | 2.73 | 0.79 | 0.027 | 0.001 | 13.93 | 16.76 | 3.06 | 0.02 | 0.01 | — | 20 |
| E58 | 0.020 | 2.45 | 0.79 | 0.026 | 0.001 | 12.82 | 17.12 | 2.01 | 0.02 | 0.01 | — | 25 |
| E59 | 0.035 | 3.50 | 0.84 | 0.026 | 0.002 | 15.20 | 17.22 | 2.74 | 0.02 | 0.02 | B: 0.008 | 16 |
| E67 | 0.045 | 3.60 | 0.75 | 0.023 | 0.001 | 14.41 | 16.94 | 2.57 | 0.04 | 0.02 | REM: 0.08 | 17 |
| E95 | 0.041 | 2.55 | 0.80 | 0.025 | 0.001 | 13.01 | 17.27 | 2.50 | 0.03 | 0.02 | V: 0.10 | 18 |
| E96 | 0.040 | 2.55 | 0.81 | 0.025 | 0.001 | 12.32 | 17.17 | 2.50 | 0.04 | 0.02 | Cu: 0.29 | 17 |
| E82 | 0.044 | 2.49 | 0.82 | 0.002 | 0.001 | 13.29 | 16.97 | 3.01 | 0.01 | 0.01 | B: 0.004 | 16 |
| E83 | 0.035 | 2.49 | 0.80 | 0.002 | 0.001 | 12.50 | 17.05 | 2.02 | 0.03 | 0.01 | B: 0.001 | 18 |

SPECIFIC DISCLOSURE OF THE INVENTION

Figure 2:
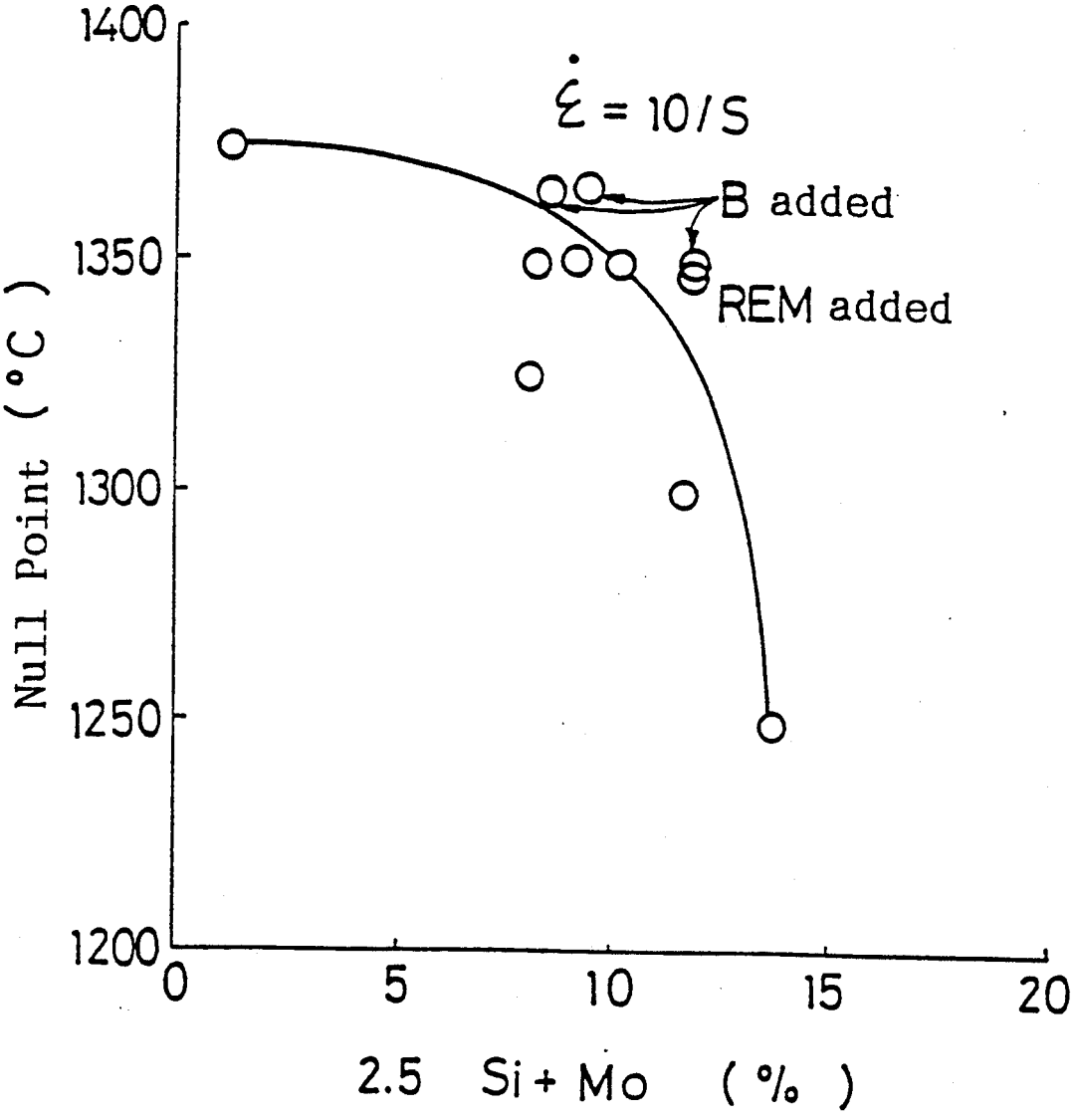
FIG. 2 is a graph showing the relation between the null point and the 2.5(Si+Mo) % value with respect to the steels of the present invention.

Now the invention will be described specifically in detail. In a fundamental experiment, steels the composi- On the other hand, as the contents of Si and Mo increase, deterioration of hot workability, weld hot cracking resistance and toughness is caused. Therefore, excessive amounts of Si and Mo cannot be contained. FIG. 2 shows the relation between the null point and the (Si+Mo)% value. The null point is the temperature at which the rupture reduction value (the value of cross-sectional reduction at rupture), is 0 when the steel specimens were subjected to a high speed high temperature tensile test at 800°-1400° C. and the rupture reduction value in % were measured. From these results, it is apparent that the null point is lowered as the contents of Si and Mo increase, and, especially, the effect of Si is 2.5 times that of Mo. This is because liquation cracking owing to intergranular melting is promoted when the contents of Si and Mo increase. Therefore, addition of large amounts of Si and Mo is not allowed and it is desirable that (2.5 Si+Mo) is not more than 11.

As shown in the drawing, when B is added, there is remarkable rise of the null point in comparison with the steels containing (si+Mo) of the same level. This is because B enhances intergranular strength and addition of B is effective for improvement of the materials which are poor in hot-workability.

For the above-described reason, addition of Si and Mo is regulated by the total amount thereof. The lower limit is determined from the viewpoint of hot salt corrosion resistance and the upper limit is determined from the viewpoint of hot-workability, weld hot cracking and $\sigma$-brittleness. When the hot-workability of the steel is not sufficient even if the upper limit amount of the content of Si and Mo, B is added. That is, B, which enhances intergranular strength, is effective for improvement of hot-workability.

Figure 4:
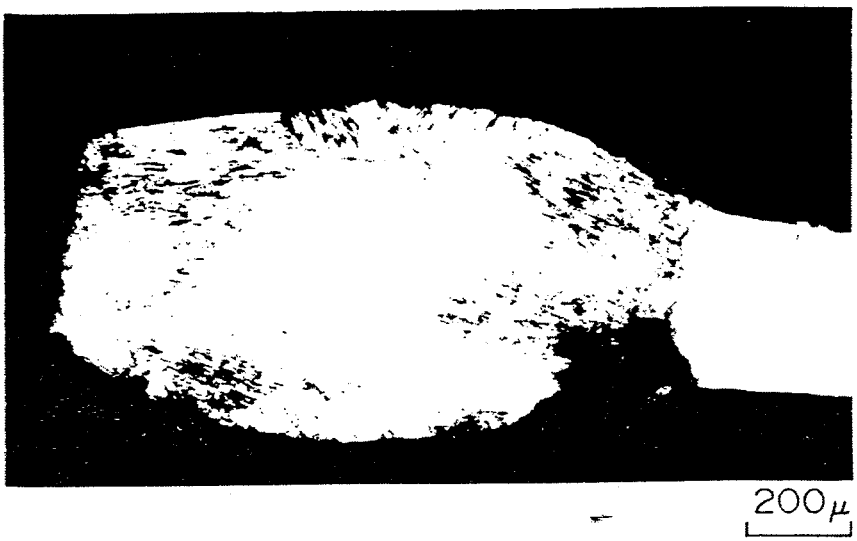
FIGS. 4–6 are microphotographs (x about 70) of TIG welding welds which were subjected to repeated heating in the presence of NaCl of SUS304 steel, SUSXM1-5JI steel and a steel of the present invention respectively.
Figure 5:
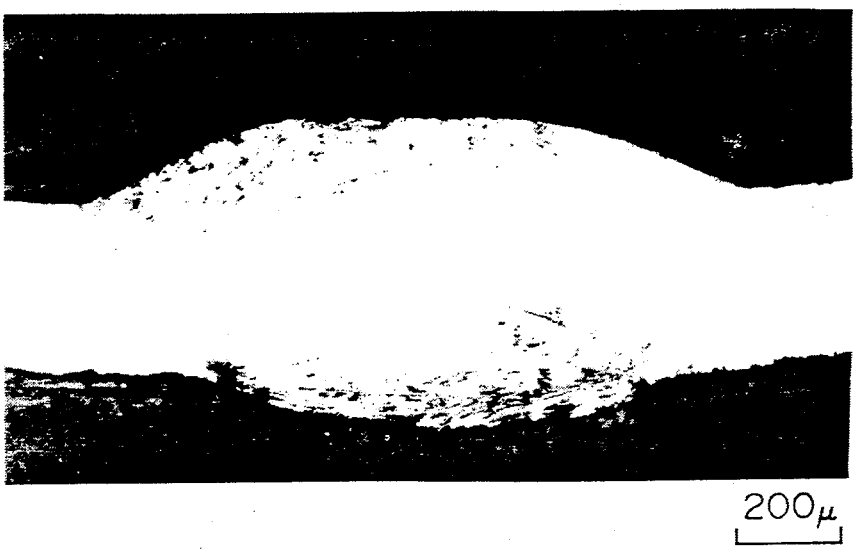
Figure 6:
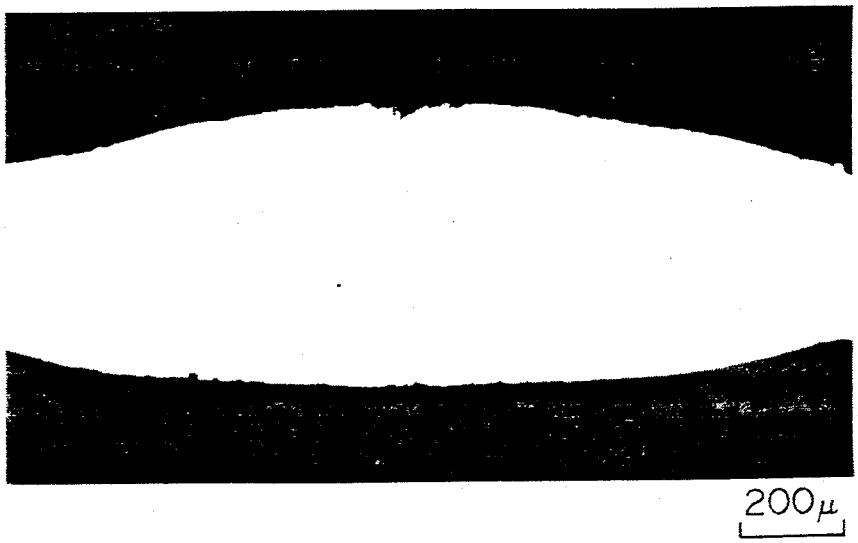

In hot salt corrosion environments, welds are often severely corroded in preference to mother metal. FIGS. 4, 5 and 6 are photomicrographs (x Ca. 70) of welds of repsectively of SUS304, SUSXM15J1 and the E57 steel specimens which underwent the following test. That is, the steels were made into plates the thickness of which is 0.3 mm or less by the ordinary hot and cold rolling and annealing. After the steel specimens were subjected to TIG welding. They were wetted with a 5% NaCl solution of 60° C. for 1 hour, dried at 60° C. for 3 days and held at 350° C. for 4 hours, and this cycle was repeated 10 times. As seen there, the weld of SUS304 steel was corroded along the δ-ferrite phase and corrosion is so remarkable at the bonds that the specimen was broken there. The weld of the SUSXM15J1 steel, which contains Si, did not suffer so serious corrosion as to be broken at the bond as SUS304, but the δ-ferrite phase was considerably selectively corroded. In contrast to these two steels, E57 steel remained completely uncorroded.

It is thought that in SUS304 and SUSXM15J1, the δ-ferrite phase is baser than the matrix and thus bond is electrochemically corroded severly, while in E57, the δ-ferrite phase per se is more resistant to corrosion because of Si and Mo, which are effective for hot salt corrosion resistance. That is to say, addition of Si and Mo is desirable for improving the corrosion resistance of not only the mother metal but also the weld. It is one of the characteristics of the present invention that the austenitic stainless steel has acquired corrosion resistance against severe corrosion environments as described above, which was not achieved by addition of Si alone.

For automobile exhaust emission control apparatuses, parts of incinerators, parts of heat exchangers, etc. fabrication of which requires welding, materials having high weld hot cracking susceptibility is fatally defective.

Figure 3:
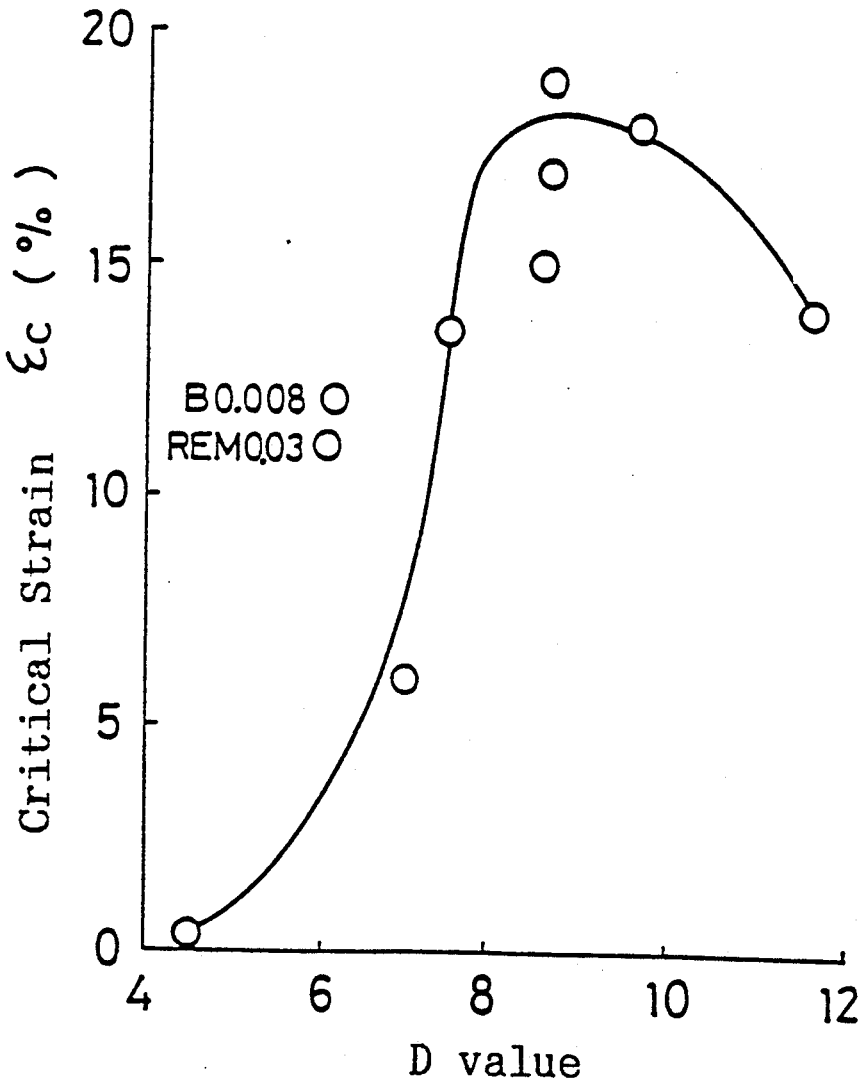
FIG. 3 is a graph showing the relation between the critical strain $\epsilon c$ (%) and the D value of the steel.

Especially, steels containing high-Si and high-Mo have high weld hot cracking susceptibility and, therefore, are difficult to use them therefor. For weld hot cracking, the δ-ferrite, which is formed in the course of solidification, plays a deleterious role. In austenite single phase steels, the initial crystals comprise austenite phase only. Therefore, impurities are concentrated at the primary grain boundaries of the austenite phase and weaken the intergranular strength causing hot cracking. If δ-ferrite is present, the δ-ferrite in the initial crystals transforms into austenite in the course of solidication, accompanied by change of grain boundaries. Therefore, in such a steel, the amount of the intergranular impurities is smaller than in austenite single phase steels, and thus weld hot cracking resistance is improved. Using steels, the compositions of which are indicated in Table 2, which form δ-ferrite, we carried out evaluation of cracking susceptibility by the weld hot cracking test and obtained the results represented by FIG. 3. Ingots of the steels of Table 2 were prepared by vacuum melting and made into 30 mm thick slabs by forging, the slabs were held at 1200° C. and thereafter, they were hot-rolled to 5 mm thick plates and further cold-rolled to 1.5 mm thick plates, which were finally annealed. The plates were worked into 40×200 mm specimens. The weld hot cracking test was carried out by holding the two ends of a specimen by the chucks and subjecting the specimen to TIG welding under a longitudinal tensile load applied. Five to ten welded samples were obtained with tensile load varied. After welding, the strain was measured from the marking lines scratched beforehand. Also, cracks in the weld generated during solidification was observed and the relation between the minimum strain at which cracking occurred (called "critical strain") and the D value, which is an index of the amount of δ-ferrite, is shown in FIG. 3. From this test, it is apparent that hot cracking resistance of the high-Si and high-Mo steel is improved by adjusting the composition thereof so that a proper amount of δ-ferrite be formed in the weld, and it is proper to adjust the D value within the range of 7-11 for that purpose when the steel does not contain B or REM. As seen in FIG. 3, when B or REM is contained in the basic composition, the cracking susceptibility abates and results better than the steels having D value of the same level but containing no D or REM are obtained. That is, a D value range of 6-11 will do.

TABLE 2

| | C | Si | Mn | S | Ni | Cr | Mo | Al | N | Others | D value |
|---|---|---|---|---|---|---|---|---|---|---|---|
| F1 | 0.035 | 2.49 | 0.82 | 0.001 | 13.50 | 16.97 | 3.01 | 0.01 | 0.01 | — | 8.5 |
| F2 | 0.039 | 2.49 | 0.80 | 0.001 | 12.38 | 17.05 | 2.02 | 0.03 | 0.01 | — | 8.6 |
| F3 | 0.041 | 2.51 | 0.80 | 0.002 | 12.10 | 17.01 | 2.02 | 0.03 | 0.02 | — | 8.6 |
| F4 | 0.036 | 2.79 | 0.79 | 0.001 | 12.61 | 17.41 | 2.30 | 0.04 | 0.01 | — | 9.6 |
| F5 | 0.042 | 2.28 | 0.80 | 0.002 | 12.05 | 16.56 | 1.74 | 0.02 | 0.02 | — | 7.5 |
| F6 | 0.045 | 2.53 | 0.79 | 0.002 | 15.99 | 16.97 | 2.02 | 0.02 | 0.02 | — | 4.5 |
| F7 | 0.039 | 2.52 | 1.58 | 0.002 | 15.00 | 18.81 | 2.01 | 0.03 | 0.02 | — | 7.1 |
| F8 | 0.031 | 2.80 | 0.72 | 0.002 | 12.22 | 18.30 | 2.72 | 0.03 | 0.01 | — | 11.5 |

TABLE 2-continued

| | C | Si | Mn | S | Ni | Cr | Mo | Al | N | Others | D value |
|---|---|---|---|---|---|---|---|---|---|---|---|
| F9 | 0.040 | 2.72 | 0.83 | 0.002 | 15.71 | 17.05 | 2.30 | 0.03 | 0.02 | B: 0.008 | 6.2 |
| F10 | 0.043 | 2.66 | 0.81 | 0.001 | 15.36 | 17.21 | 2.45 | 0.03 | 0.02 | REM: 0.03 | 6.0 |

As described above, we studied the composition of the heat resistant austenitic stainless steel from the viewpoints of hot salt cracking resistance, hot-workability and weld hot cracking resistance and now provide a heat resistant high-Si and high-Mo austenitic stainless steel provided with the above-mentioned properties of high level.

WORKING EXAMPLES

Now the invention will be illustrated by way of working examples and comparative examples.

Steels the compositions of which are shown in Table 3 were prepared and made into the specimens as described above and they were tested in the same manner. The results of the tests, i.e., corrosion weight loss in the hot salt corrosion test, critical strain obtained in the weld hot cracking test and the null point from the high temperature tensile test, are summarised in Table 3. The specimens and the methods employed were entirely the same as those employed in the tests relating to FIGS. 1, 2 and 3. From this table, the following facts are apparent. Comparative Still E74, which is outside of the claimed composition in that it does not positively contain Mo and the Si content is low, exhibits a very large weight loss. Steel E75, which does not positively contain Mo, suffers high degree corrosion and the null point thereof is low because of high content of Si. Although the D value was adjusted to 8.8 so that some amount of δ-ferrite was formed, the critical strain is very low because of high content of Si. Steel E76, which contains high degrees of Si and Mo, has a low null point and a very low critical strain. Steel F6, the composition of which falls in the general composition range of the present invention but out of the claimed scope in that the D value thereof is as low as 4.5, exhibited an extremely low critical strain. Steel E77, the composition of which falls in the general composition range of the present invention but out of the claimed scope in that the D value is too high, was corroded along the δ-ferrite grains and exhibited a large corrosion weight loss. The known Steel SUS304 markedly suffered corrosion. The known Steels SUS302B and SUSXM15J1 positively containing Si exhibited less corrosion weight losses than SUS304 but the weight losses were significantly larger in comparison with the steels of the present invention, because the former steels do not contain Mo.

TABLE 3

| | C | Si | Mn | P | S | Ni | Cr | Mo | Al | N | Cu | Nb |
|---|---|---|---|---|---|---|---|---|---|---|---|---|
| Invention Steels | | | | | | | | | | | | |
| F1 | 0.035 | 2.49 | 0.82 | 0.02 | 0.001 | 13.50 | 16.97 | 3.01 | 0.01 | 0.01 | — | — |
| E57 | 0.034 | 2.73 | 0.79 | 0.03 | 0.001 | 13.93 | 16.76 | 3.06 | 0.02 | 0.01 | — | — |
| E60 | 0.033 | 2.72 | 0.78 | 0.02 | 0.002 | 12.29 | 17.20 | 2.80 | 0.03 | 0.01 | 1.24 | — |
| E61 | 0.047 | 3.67 | 0.82 | 0.02 | 0.002 | 15.85 | 19.36 | 2.19 | 0.01 | 0.01 | — | 0.29 |
| E62 | 0.040 | 2.65 | 0.92 | 0.02 | 0.002 | 13.10 | 17.35 | 2.40 | 0.02 | 0.02 | — | — |
| F9 | 0.040 | 2.72 | 0.83 | 0.02 | 0.002 | 15.11 | 17.05 | 2.30 | 0.03 | 0.02 | — | — |
| E63 | 0.042 | 2.48 | 0.80 | 0.02 | 0.002 | 14.28 | 17.15 | 2.62 | 0.03 | 0.02 | — | 0.10 |
| E64 | 0.035 | 2.72 | 0.94 | 0.02 | 0.002 | 11.09 | 17.50 | 2.38 | 0.03 | 0.02 | 1.20 | 0.11 |
| E65 | 0.040 | 2.50 | 0.94 | 0.02 | 0.002 | 13.09 | 17.45 | 2.70 | 0.03 | 0.02 | 1.00 | — |
| E66 | 0.042 | 2.71 | 0.85 | 0.02 | 0.002 | 13.46 | 17.60 | 2.95 | 0.03 | 0.02 | 1.02 | 0.10 |
| F10 | 0.043 | 2.66 | 0.81 | 0.02 | 0.001 | 15.36 | 17.21 | 2.45 | 0.03 | 0.02 | — | — |
| E67 | 0.038 | 2.71 | 0.85 | 0.02 | 0.002 | 12.95 | 17.53 | 2.62 | 0.03 | 0.02 | 1.05 | — |
| E68 | 0.042 | 2.50 | 0.85 | 0.02 | 0.002 | 13.55 | 17.05 | 2.38 | 0.03 | 0.02 | — | 0.10 |
| E69 | 0.040 | 2.55 | 0.80 | 0.02 | 0.002 | 14.37 | 17.10 | 2.45 | 0.03 | 0.02 | — | — |
| E70 | 0.041 | 2.57 | 0.80 | 0.02 | 0.002 | 14.49 | 17.15 | 2.62 | 0.03 | 0.02 | — | 0.11 |
| E71 | 0.044 | 2.70 | 0.80 | 0.02 | 0.002 | 12.92 | 17.70 | 2.55 | 0.03 | 0.02 | 1.05 | 0.11 |
| E72 | 0.042 | 2.53 | 0.81 | 0.02 | 0.002 | 13.21 | 17.73 | 2.65 | 0.03 | 0.02 | 1.00 | — |
| E73 | 0.045 | 2.65 | 0.82 | 0.02 | 0.002 | 13.19 | 17.65 | 2.57 | 0.03 | 0.02 | 1.03 | 0.13 |
| Known & Comparative | | | | | | | | | | | | |
| E74 | 0.038 | 0.48 | 0.80 | 0.02 | 0.002 | 8.30 | 16.80 | 0.44 | 0.03 | 0.01 | — | — |
| E75 | 0.047 | 4.70 | 0.79 | 0.02 | 0.002 | 13.53 | 17.10 | 0.48 | 0.03 | 0.02 | — | — |
| E76 | 0.055 | 4.80 | 0.82 | 0.02 | 0.002 | 17.74 | 17.20 | 4.90 | 0.03 | 0.02 | — | — |
| F6 | 0.045 | 2.53 | 0.79 | 0.02 | 0.002 | 15.99 | 16.97 | 2.02 | 0.03 | 0.02 | — | — |
| E77 | 0.038 | 2.50 | 0.80 | 0.02 | 0.001 | 10.01 | 19.40 | 2.80 | 0.03 | 0.01 | — | — |
| SUS304 | 0.06 | 0.48 | 1.20 | 0.02 | 0.008 | 8.11 | 18.31 | — | — | 0.03 | — | — |
| SUS302B | 0.08 | 2.60 | 0.79 | 0.02 | 0.006 | 9.41 | 17.72 | — | — | 0.01 | — | — |
| SUSXM15J1 | 0.05 | 3.41 | 0.85 | 0.02 | 0.004 | 12.84 | 19.08 | — | — | 0.01 | — | 0.12 |

| | Ti | V | B | REM | D value | Wt. loss ($mg/cm^2$) | Crit. strain (%) | Null Pt. (°C.) |
|---|---|---|---|---|---|---|---|---|
| Invention Steels | | | | | | | | |
| F1 | — | — | — | — | 8.5 | 20 | 15 | 1360 |
| E57 | — | — | — | — | 8.5 | 20 | 16 | 1360 |
| E60 | — | — | — | — | 7.8 | 25 | 17 | 1360 |
| E61 | 0.10 | — | — | — | 8.5 | 23 | 15 | 1325 |
| E62 | — | 0.15 | — | — | 8.5 | 23 | 19 | 1360 |
| F9 | — | — | 0.008 | — | 6.2 | 28 | 12 | 1360 |
| E63 | — | — | 0.006 | — | 7.0 | 28 | 17 | 1360 |
| E64 | — | 0.11 | — | — | 8.5 | 26 | 19 | 1350 |
| E65 | — | — | 0.010 | — | 7.8 | 20 | 18 | 1360 |
| E66 | — | 0.11 | 0.011 | — | 7.0 | 19 | 15 | 1360 |
| F10 | — | — | — | 0.030 | 6.0 | 25 | 11 | 1350 |

TABLE 3-continued

| | | | | | | | | |
|---|---|---|---|---|---|---|---|---|
| E67 | — | — | — | 0.033 | 7.1 | 25 | 15 | 1350 |
| E68 | — | — | — | 0.035 | 7.4 | 27 | 15 | 1350 |
| E69 | — | — | 0.008 | 0.030 | 6.9 | 28 | 17 | 1360 |
| E70 | — | — | 0.008 | 0.031 | 7.0 | 25 | 17 | 1360 |
| E71 | — | — | — | 0.030 | 7.2 | 26 | 15 | 1350 |
| E72 | — | — | 0.009 | 0.037 | 6.8 | 25 | 17 | 1360 |
| E73 | — | — | 0.010 | 0.033 | 6.8 | 24 | 15 | 1360 |
| Known & Comparative | | | | | | | | |
| E74 | — | — | — | — | 8.0 | 100 | ≧20 | 1375 |
| E75 | — | — | — | — | 8.8 | 38 | 5 | 1300 |
| E76 | — | — | — | — | 9.0 | 16 | 5 | 1300 |
| F6 | — | — | — | — | 4.5 | 29 | 0.2 | 1360 |
| E77 | — | — | — | — | 14.1 | 45 | 8 | 1325 |
| SUS304 | — | — | — | — | 7.4 | 98 | ≧20 | 1375 |
| SUS302B | — | — | — | — | 9.1 | 52 | 20 | 1360 |
| SUSXM15J1 | — | — | — | — | 8.8 | 48 | 18 | 1325 |

In contrast with the above described known and comparative steels, Steels F1 and E57 of the present invention contain Si and Mo, which are effective for hot salt corrosion resistance, exhibited small corrosion weight losses, high critical strains and high null points, because the D value is adjusted to 8.5. Steel E60 contains Si and Mo, which are effective for hot salt corrosion resistance, as well as Cu, which is effective for stress corrosion cracking resistance, recorded a small corrosion weight loss, a high critical strain and a high null point like F1 and E57. Steels E61–E66 and F9 positively contain Si and Mo like the above-described steels, and, therefore, their corrosion weight losses are small. Of these steels, E61 contains Nb and Ti which are especially effective for improvement of creep strength, E62 contains V from the same consideration, and E64 contain Cu, Nb and V and their D values were adjusted to 6.2–8.5, which is a range proper for prevention of weld hot cracking. These steels exhibited high critical strain values. Steels F9, E63, E65 and E66 contain B, which is effective for improving hot workability, and in addition to Cu, Nb or Ti or V. Therefore, they exhibited high null points.

Steels F10 and E67–E73 positively contain Si and Mo, which are effective for hot salt cracking resistance, like the above-described steels and, therefore, their corrosion weight losses are small. They also contain REM, which are effective for improvement of weld hot cracking and, resistance therefore, they recorded high critical strain values although their D values are relatively low. Of these, E67 further contains Cu, E68 contains Nb and E71 contains Cu and Nb, but their null points are high. E69, E70, E72 and E73 contains B in addition to REM or Nb, etc., and, therefore, their null points are high. As has been described above, the steels of the present invention, are provided with excellent hot salt corrosion resistance, excellent weld hot cracking resistance as well as excellent hot-workability.

We claim:

1. A heat-resistant austenitic stainless steel essentially consisting of:

C: not more than 0.06%,
Si: 1–4%
Mn: 0.5–4%
P: not more than 0.035%,
S: not more than 0.005%,
Ni: 10–17%
Cr: 14–20%
Mo: 1–4%
Al: 0.01–0.5%
N: not more than 0.035% the balance being Fe and unavoidable impurities, wherein the total content of Si and Mo satisfies the formula (1) and (2) below, and the D value as defined by the formula (3) below is 7–11, said steel having excellent hot salt corrosion resistance, weldability, salt corrosion resistance of weld and hot-workability $$(Si\ \% + Mo\ \%) \geqq 3\% \quad (1)$$

$$(2.5\ Si\ \% + Mo\ \%) \leqq 11\% \quad (2)$$

$$D = (Cr\ \% + 1.5\ Si\ \% + Mo\ \% + 3Al\ \% + 2.6\ Ti\ \% + 0.5\ Nb\ \% + 0.5\ V\ \%) - (Ni\ \% + 30\ C\ \% + 30\ N\ \% + 2\ Cu\ \% + 0.5\ Mn\ \%) \quad (3).$$

2. The steel as claimed in claim 1, which further contains 0.5–2.5% Cu.

3. The steel as claimed in claim 1 or 2, which further contains 0.005–0.1% of one or more of REM and the D value is 6–11.

4. A heat-resistant austenitic stainless steel essentially consisting of:

C: not more than 0.06%,
Si: 1–4%
Mn: 0.5–4%
P: not more than 0.035%,
S: not more than 0.005%,
Ni: 10–17%
Cr: 14–20%
Mo: 1–4%
Al: 0.01–0.5%
N: not more than 0.035%
one or more of Nb, Ti and V: 0.05–0.5% in total.
and/or
B: 0.05–0.02% the balance being Fe and unavoidable impurities, wherein the total content of Si and Mo satisfies the formula (1) and (2) below, and the D value as defined by the formula (3) is 6–11, when the steel contains B and is 7–11 when the steel does not contain B, said steel having excellent hot salt corrosion resistance, weldability, salt corrosion resistance of weld and hot-workability $$(Si\ \% + Mo\ \%) \geqq 3\% \quad (1)$$

$$(2.5\ Si\ \% + Mo\ \%) \leqq 11\% \quad (2)$$

$$D = (Cr\ \% + 1.5\ Si\ \% + Mo\ \% + 3\ Al\ \% + 2.6\ Ti\ \% + 0.5\ Nb\ \% + 0.5\ V\ \%) - (Ni\ \% + 30\ C\ \% + 30\ N\ \% + 2\ Cu\ \% + 0.5\ Mn\ \%) \quad (3).$$

5. The steel as claimed in claim 4, which further contains 0.5–2.5% Cu.

6. The steel as claimed in claim 4 or 5, which further contains 0.005–0.1% of one or more of REM, wherein the D value is 6–11.

7. The steel as claimed in any one of claims 1, 2, 4 or 5, wherein
the C content is 0.03–0.060%,
the Si content is 2–3%,
the Mn content is 0.5–1%,
the P content is not more than 0.03%,
the S content is not more than 0.005%,
the Ni content is 12–16%,
the Cr content is 16–18%,
the Mo content is 2–3.2%,
the Al content is 0.01–0.03%, and
the N content is not more than 0.03%.

8. The stainless steel as claimed in any one of claims 1, 2, 4 or 5, wherein
the C content is 0.03–0.05%
the Si content is 2–2.8%
the Mn content is 0.5–1%,
the P content is not more than 0.03%,
the S content is not more than 0.005%
the Ni content is 12–14%,
the Cr content is 16–18%,
the Mo content is 2–2.8%,
the Al content is 0.01–0.03%
the N content is not more than 0.03% and
the balance being Fe and unavoidable impurities.

9. The steel as claimed in claim 3 wherein
the C content is 0.03–0.060%,
the Si content is 2–3%,
the Mn content is 0.5–1%,
the P content is not more than 0.03%,
the S content is not more than 0.005%,
the Ni content is 12–16%,
the Cr content is 16–18%,
the Mo content is 2–3.2%,
the Al content is 0.01–0.03%, and
the N content is not more than 0.03%.

10. The steel as claimed in claim 6 wherein
the C content is 0.03–0.060%,
the Si content is 2–3%,
the Mn content is 0.5–1%,
the P content is not more than 0.03%,
the S content is not more than 0.005%,
the Ni content is 12–16%,
the Cr content is 16–18%,
the Mo content is 2–3.2%,
the A content is 0.01–0.03%, and
the N content is not more than 0.03%.

11. The steel as claimed in claim 3 wherein
the C content is 0.03–0.05%,
the Si content is 2–2.8%
the Mn content is 0.5–1%,
the P content is not more than 0.03%,
the S content is not more than 0.05%,
the Ni content is 12–14%,
the Cr content is 16–18%,
the Mo content is 2–2.8%,
the A content is 0.01–0.03%,
the N content is not more than 0.03%, and
the balance being Fe and unavoidable impurities.

12. The steel as claimed in claim 6 wherein
the C content is 0.03–0.05%,
the Si content is 2–2.8%
the Mn content is 0.5–1%,
the P content is not more than 0.03%,
the S content is not more than 0.05%,
the Ni content is 12–14%,
the Cr content is 16–18%,
the Mo content is 2–2.8%,
the A content is 0.01–0.03%,
the N content is not more than 0.03%, and
the balance being Fe and unavoidable impurities.

13. The steel as claimed in claim 7 wherein
the C content is 0.03–0.05%,
the Si content is 2–2.8%
the Mn content is 0.5–1%,
the P content is not more than 0.03%,
the S content is not more than 0.05%,
the Ni content is 12–14%,
the Cr content is 16–18%,
the Mo content is 2–2.8%,
the A content is 0.01–0.03%,
the N content is not more than 0.03%, and
the balance being Fe and unavoidable impurities.

* * * * *

UNITED STATES PATENT AND TRADEMARK OFFICE

CERTIFICATE OF CORRECTION

PATENT NO. : 4,999,159

DATED : March 12, 1991

INVENTOR(S) : Yoshihiro Uematsu, Isami Shimizu and Naoto Hiramatsu

It is certified that error appears in the above-identified patent and that said Letters Patent is hereby corrected as shown below:

Abstract Line 3 "mn" should read --Mn--.

Column 2 Line 9 "anstenitic" should read --austenitic--.

Column 2 Line 10 "crocking" should read --cracking--.

Column 3 Line 15 after "0.05" insert --%--.

Column 3 Line 15 after "2.8" insert --%--.

Column 3 Line 16 after "0.03" insert --%--.

Column 3 Line 17 after "14" insert --%--.

Column 3 Line 17 after "2.8" insert --%--.

UNITED STATES PATENT AND TRADEMARK OFFICE

CERTIFICATE OF CORRECTION

PATENT NO. : 4,999,159

DATED : March 12, 1991

INVENTOR(S) : Yoshihiro Uematsu, Isami Shimizu and Naoto Hiramatsu

It is certified that error appears in the above-identified patent and that said Letters Patent is hereby corrected as shown below:

Column 4 Line 61 before "spoils" delete --which--.

Column 5 Line 3 "degrade" should read --degrades--.

Column 5 Lines 41-42 "SUSXM15JI" should read --SUSXM15J1--.

Column 6 Line 41 after "less" insert --than--.

Column 6 Line 43 "corrision" should read --corrosion--.

Column 7 Line 19 "si" should read --Si--.

Column 7 Line 36 "repsectively" should read --respectively--.

Column 7 Line 54 after "thus" insert --the--.

UNITED STATES PATENT AND TRADEMARK OFFICE

CERTIFICATE OF CORRECTION

PATENT NO. : 4,999,159 Page 3 of 3

DATED : March 12, 1991

INVENTOR(S) : Yoshihiro Uematsu, Isami Shimizu and Naoto Hiramatsu

It is certified that error appears in the above-identified patent and that said Letters Patent is hereby corrected as shown below:

Column 8 Line 22 "solidication" should read --solidification--.

Column 9 Line 28 "Still" should read --Steel--.

Table 3, under E62, Null Pt. ($^{O}$C) "1360" should read --1350--.

Claim 10 Line 6 Column 14 "A" should read --Al--.

Claim 11 Line 17 Column 14 "A" should read --Al--.

Claim 12 Line 29 Column 14 "A" should read --Al--.

Claim 13 Line 41 Column 14 "A" should read --Al--.

Signed and Sealed this

Second Day of March, 1993

*Attest:*

STEPHEN G. KUNIN

*Attesting Officer*

*Acting Commissioner of Patents and Trademarks*